US008424153B2

(12) United States Patent
Fester et al.

(10) Patent No.: US 8,424,153 B2
(45) Date of Patent: Apr. 23, 2013

(54) VACUUM CLEANER AND FILTERS THEREFOR

(75) Inventors: Joseph A. Fester, Ada, MI (US); Timothy A. Field, Holland, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 998 days.

(21) Appl. No.: 12/407,126

(22) Filed: Mar. 19, 2009

(65) Prior Publication Data

US 2010/0236014 A1 Sep. 23, 2010

(51) Int. Cl.
*A47L 9/10* (2006.01)

(52) U.S. Cl.
USPC ..... 15/347; 15/345; 15/349

(58) Field of Classification Search ..... 15/345, 15/347, 349
See application file for complete search history.

(56) References Cited

U.S. PATENT DOCUMENTS

| | | | | |
|---|---|---|---|---|
| 2,183,737 | A | 12/1939 | Bilde Tord | |
| 3,082,587 | A | 3/1963 | Brimerg | |
| 3,204,395 | A | 9/1965 | Howard | |
| 6,709,495 | B1 | 3/2004 | Storer | |
| 6,807,707 | B2 | 10/2004 | Park et al. | |
| 6,829,805 | B2 * | 12/2004 | Yang | 15/347 |
| 6,868,579 | B2 * | 3/2005 | Yang | 15/347 |
| 7,076,831 | B1 | 7/2006 | Ji | |
| 7,185,394 | B2 | 3/2007 | Hafling et al. | |
| 7,444,712 | B2 * | 11/2008 | Wiedemann | 15/347 |
| 7,581,286 | B2 * | 9/2009 | Choi | 15/352 |
| 2002/0170138 | A1 * | 11/2002 | Huebsch et al. | 15/340.2 |
| 2007/0209147 | A1 | 9/2007 | Krebs et al. | |
| 2008/0010958 | A1 | 1/2008 | Fester et al. | |
| 2011/0113589 | A1 * | 5/2011 | Geither | 15/347 |

FOREIGN PATENT DOCUMENTS

WO 2007008770 A2 1/2007

* cited by examiner

*Primary Examiner* — Lee D Wilson
*Assistant Examiner* — Shantese McDonald
(74) *Attorney, Agent, or Firm* — McGarry Bair PC

(57) ABSTRACT

An upright vacuum cleaner has a compact, cylindrical exhaust filter assembly that is easily accessible by a user. The filter is removably mounted in a housing between an exhaust outlet aperture and a suction source outlet. A filter locking lug is associated with the filter element and the housing for removably securing the filter element to the housing to the filter frame. An upright vacuum cleaner has a pre-motor filter assembly that is highly visible to a user and accessible thereby.

19 Claims, 8 Drawing Sheets

VACUUM CLEANER AND FILTERS THEREFOR

BACKGROUND OF THE INVENTION

1. Field of the Invention

The invention relates to vacuum cleaner filtration. In one of its aspects, the invention relates to a vacuum cleaner having an improved filtration system. In another of its aspects, the invention relates to an improved post-motor exhaust filter for filtering particles downstream from a vacuum motor. In another of its aspects, the invention relates to an improved mounting for a post-motor exhaust filter. In another of its aspects, the invention relates to an improved pre-motor filter for filtering particles downstream from a dirty air separator.

2. Description of the Related Art

Upright vacuum cleaners have a main filtration or separation assembly for separating dust and debris from the working airstream that is drawn into the vacuum cleaner by the vacuum source. The main filtration assembly typically comprises a conventional filter bag or a centrifugal separator assembly. Vacuum cleaners that include cyclone separators are well-known in the art. Cyclone separator designs commonly employ frusto-conical shaped separators, while others use high-speed rotational motion of the air/dirt in a cylindrical separator to separate the dirt by centrifugal force. Typically, working air enters and exits at an upper portion of the cyclone separator while the bottom portion of the cyclone separator is used to collect debris. It is further known to employ multiple serial cyclone separators to improve the collection of fine debris particles that may not be collected by a single separator.

Vacuum cleaners further have at least one motor/fan assembly for generating suction to draw air and debris into the vacuum cleaner and, optionally, for driving an agitator, such as a brushroll, mounted in the foot of the vacuum cleaner. Alternatively, vacuum cleaners frequently have a vacuum motor/fan for generating suction airflow and a second dedicated motor assembly for driving an agitator. Air for cooling each motor/fan assembly is drawn into the vacuum cleaner and subsequently exhausted through separate ports in the vacuum cleaner housing. As the cooling air passes through the motor assemblies, carbon dust generated by the motor brushes can become entrained in the airstream and thus exhausted from the vacuum cleaner. The emitted carbon dust can lead to contamination of the home environment. To alleviate this contamination, the motor cooling air can be filtered after it has passed through the respective motors. On vacuum cleaners having both a vacuum and an agitator motor, separate filters can be placed at the respective exhaust ports to remove carbon dust from each motor cooling airstream, however, these filters can add expense and bulk to the vacuum cleaner. A high efficiency particle arrestor (HEPA) filter is commonly used for this purpose. To reduce expense and bulk and to improve ease of use, the vacuum and agitator motor cooling exhaust path(s) can be configured to pass through a single exhaust filter downstream from the vacuum and agitator motors to trap carbon dust together with any residual fine dust remaining in the air stream. The filter mounting location depends on unit architecture and is preferably configured to provide a hermetic sealing surface that is accessible by a user. A seal between the housing and the filter is important to prevent dust or other contaminates from escaping the vacuum cleaner into the home environment. It is desirable to implement a compact exhaust filter that is easily accessible and replaceable by a user and capable of containing residual dust and carbon particulates emitted by the system.

BISSELL Homecare, Inc. presently manufactures and sells in the United States an upright vacuum cleaner configured to port agitator motor cooling exhaust air to a working air conduit upstream of a vacuum fan inlet as disclosed in U.S. Patent Application Publication No. 20070209147, which is incorporated herein by reference in its entirety. The working air exits through a single HEPA exhaust filter that is mounted on a curved sealing surface at the side of the unit.

SUMMARY OF THE INVENTION

A vacuum cleaner according to the invention comprises a housing including a suction nozzle and a dirty air separator for removing dirt and debris from a dirt laden air stream, at least one suction source mounted in the housing having a suction inlet connected to the dirty air separator and the suction nozzle to draw air into the suction nozzle and through the dirty air separator, and having a suction source outlet, an exhaust outlet aperture in the housing connected to the suction source outlet, and a filter element mounted in the housing between the exhaust outlet aperture and the suction source outlet. A filter locking lug is associated with the filter element and the housing for removably securing the filter element to the housing. In one embodiment, the filter element is cylindrical and includes a central hub in which the locking lug is retained. Desirably, a seal is positioned between the housing and the filter element to prevent dust from escaping the housing.

In one embodiment, the filter element comprises a filter frame that includes a cavity that receives a filter, and the housing comprises a locking lug retainer that is adapted to removably retain the locking lug.

In yet another embodiment, the filter frame and locking lug comprises an interlocking connection that is adapted to rotatably mount the locking lug in the filter frame. In one embodiment, the interlocking connection comprises integral resilient arms and a flange. The integral resilient arms can be formed on the locking lug and the flange can be formed on the filter frame. In another embodiment, the interlocking connection comprises integral ramps and a flange. The integral ramps can be formed on the locking lug and the flange can be formed on the filter frame.

The interlocking connection preferably precludes removal of the filter locking lug from the filter frame without the use of tools. Typically, the locking lug is rotatably receivable within the locking lug retainer. In one embodiment, there is threaded connection between the locking lug and the locking lug retainer. In another embodiment, the filter locking lug further includes a grip.

A filter assembly for a vacuum cleaner according to another embodiment comprises a filter element comprising a filter frame that includes a cavity that receives a filter and a filter locking lug wherein the filter locking lug and the filter element include an interlocking connection that is adapted to rotatably mount the locking lug in the filter frame. Preferably, the filter frame and locking lug comprises an interlocking connection that is adapted to rotatably mount the locking lug in the filter frame. In one embodiment, the interlocking connection comprises integral resilient arms and a flange. The integral resilient arms can be formed on the locking lug and the flange can be formed on the filter frame. In another embodiment, the interlocking connection comprises integral ramps and a flange. The integral ramps can be formed on the locking lug and the flange can be formed on the filter frame. The interlocking connection is designed to preclude removal of the filter locking lug from the filter frame without the use of tools. Typically, the filter element is cylindrical and includes a central hub wherein the locking lug is retained. The filter locking lug can have a grip to facilitate insertion of the locking lug into the hub.

A vacuum cleaner according to yet another embodiment of the invention comprises a housing including a suction nozzle and a dirty air separator, having an inlet and an outlet, for removing dirt and debris from a dirt laden air stream, at least one suction source mounted in the housing having a suction inlet fluidly connected to the dirty air separator and the suction nozzle to draw air into the suction nozzle and through the dirty air separator, and having a suction source outlet. A filter element is removably mounted in an upper portion of the housing between the dirty air separator outlet and the suction source inlet wherein the filter element is visible to a user when the dirty air separator is removed from the housing. The filter element may include a filter cover and foam filter and the housing may include an inlet plenum for capturing the foam filter. Desirably, the filter cover is comprised of transparent material.

In yet another embodiment, the filter cover and inlet plenum include an interlocking connection that is adapted to removably mount the filter cover in the inlet plenum. The interlocking connection can include a latch tab and latch tab receiver. The interlocking connection can also include at least one engagement rib and at least one rib recess.

DESCRIPTION OF THE PREFERRED EMBODIMENT

Figure 1:
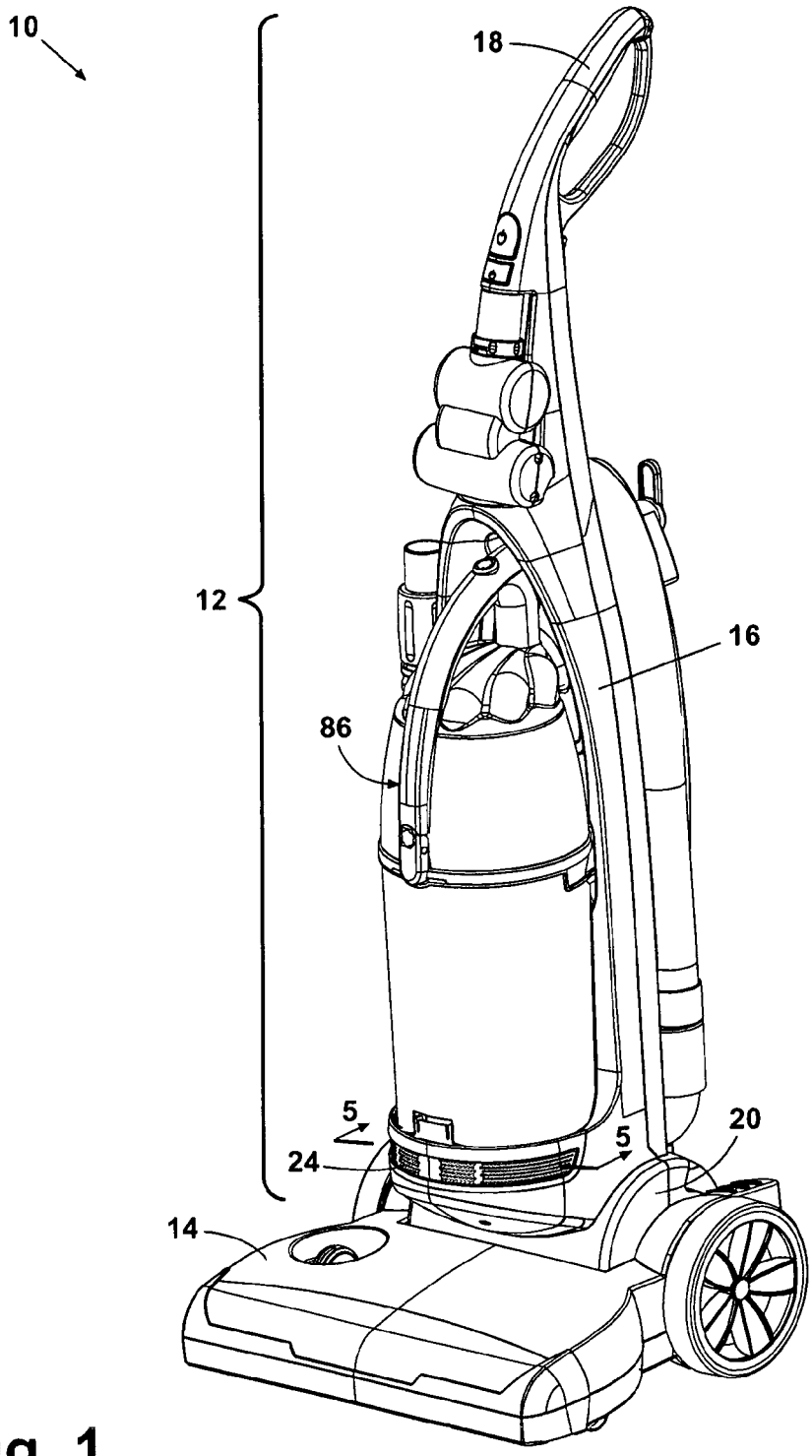
FIG. 1 is a perspective view of an upright vacuum cleaner with a filtration system according to the invention.
Figure 2:
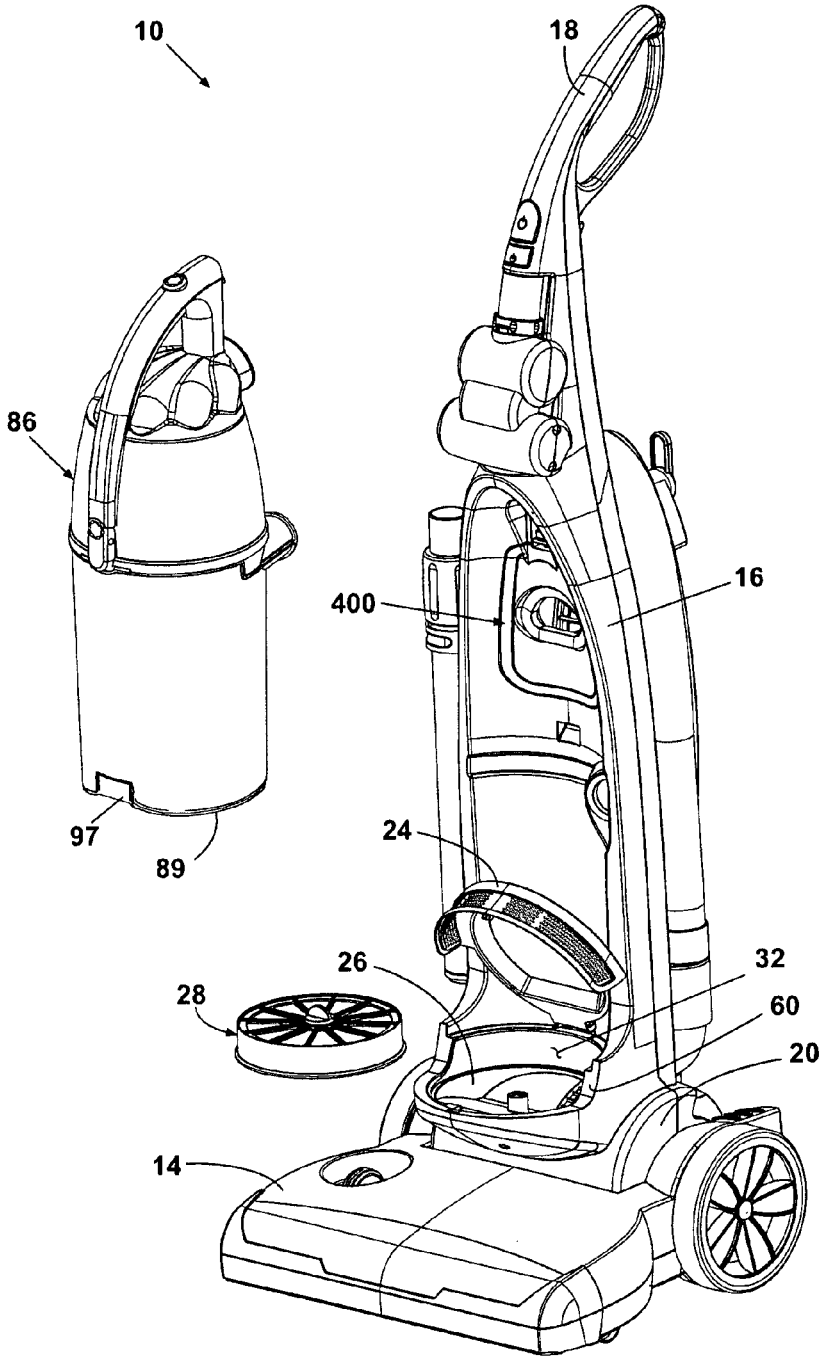
FIG. 2 is a perspective view of the upright vacuum cleaner of FIG. 1 where the cyclone module is removed, the filter access door is in an open position and the exhaust filter assembly is removed from the filter chamber.

Referring to FIGS. 1-2, an upright vacuum cleaner 10 is described and comprises a handle assembly 12 pivotally mounted to a cleaning foot assembly 14. The handle assembly 12 comprises a primary support section 16 with a handgrip 18 at one end to facilitate movement by a user across a surface to be cleaned. A motor cavity 20 is formed at an opposite end of the handle assembly 12 to house a suction source formed by a motor/fan assembly 22 (not shown). An exhaust filter door 24 is pivotally mounted to the lower portion of the primary support section 16 to provide selective access to an exhaust filter chamber 26 for cleaning or replacing an exhaust filter assembly 28 according to the present invention.

Figure 3:
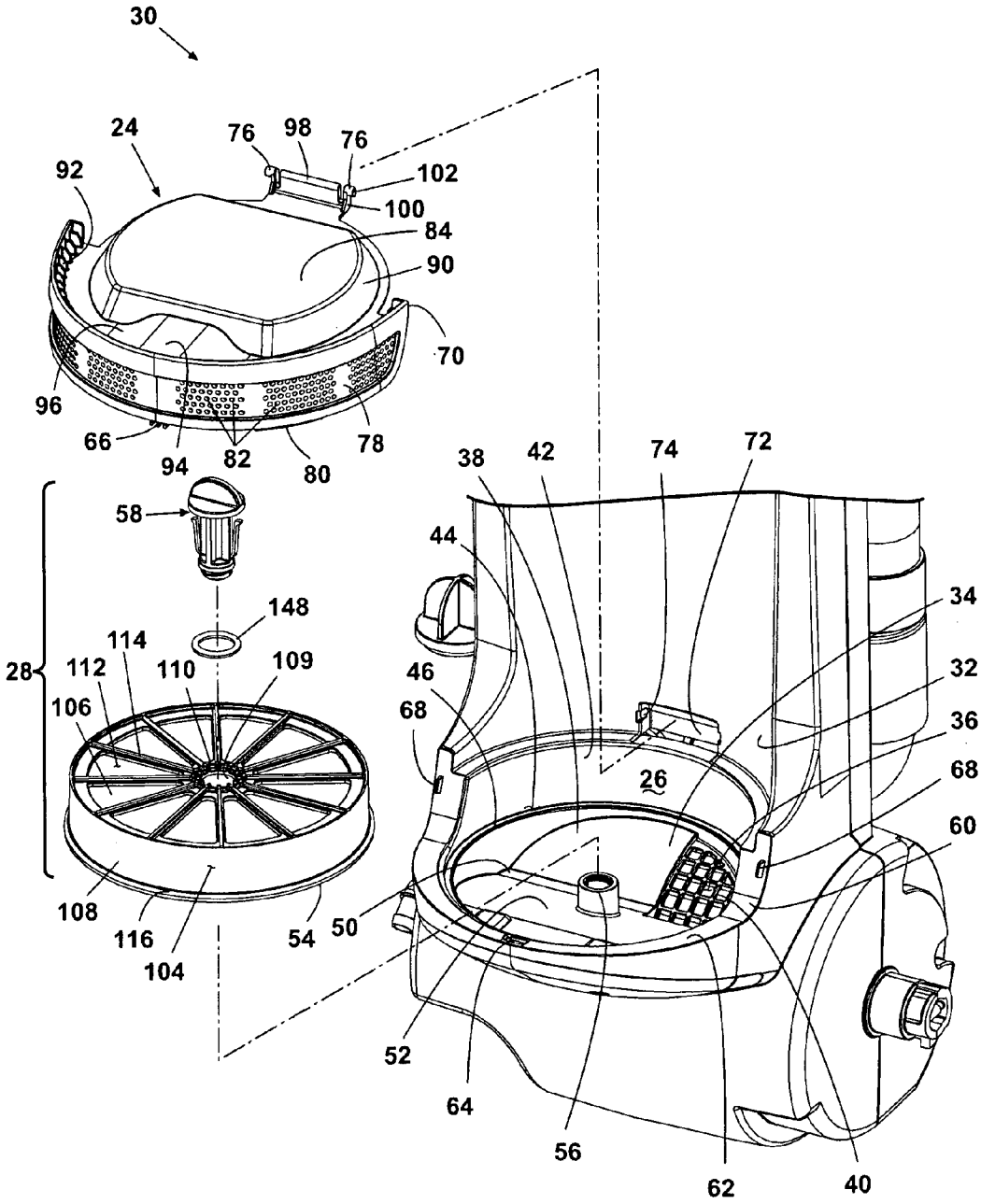
FIG. 3 is a partial exploded perspective view of the exhaust filter assembly and filter mounting chamber of the vacuum cleaner of FIG. 1

Referring to FIG. 3, the exhaust filter module 30 comprises an exhaust filter chamber 26 configured to receive a removable and replaceable exhaust filter assembly 28 and a pivotally mounted exhaust filter door 24. A cylindrical recess 32 formed at a lower portion of the primary support section 16 at the top of a vacuum motor/fan housing 34 defines the filter chamber 26 which is selectively enclosed by the exhaust filter door 24. The filter chamber 26 is fluidly connected to the vacuum fan/motor exhaust compartment (not shown) via an exhaust outlet aperture 36 formed in a rear portion of an arcuate bottom wall 38. A protective grill 40 is formed within the exhaust outlet aperture 36 to limit access to the vacuum motor exhaust compartment (not shown). The filter chamber 26 further comprises a stepped cylindrical wall 42 that forms a horizontal seat 44 to support the exhaust filter assembly 28. The seat 44 further comprises an upwardly protruding sealing rib 46 for engaging a resilient gasket 48 (FIG. 5) on the bottom of the exhaust filter assembly 28. A depression 50 is formed at the bottom of the filter chamber 26 by a front and rear diverging bottom wall 52, 38. The two walls 38, 52 connect near the middle of the filter chamber 26 adjacent to the exhaust outlet aperture 36. Each wall 38, 52 projects upwardly and eventually joins with the cylindrical filter chamber wall at opposing sides beneath the filter seat 44. The depression 50 created by the two divergent walls 38, 52 provides an empty volume between the exhaust filter bottom 54 and the exhaust outlet aperture 36 to distribute exhaust air across the filter assembly 28. A cylindrical locking lug retainer formed by a retention hub 56 protrudes upwardly from the center of the filter chamber 26. The retention hub 56 further comprises threads formed on an inner surface thereof for receiving and securing a filter locking lug 58, which, in turn, fastens the exhaust filter assembly 28 to the filter chamber 26.

With continued reference to FIG. 3, a cut out section 60 at the front lower portion of the primary support section forms a flat lip 62 that supports an exhaust filter door 24. The lip 62 further comprises a slot 64 at the front for selectively receiving a filter door engagement tab 66. Two short locating ribs 68 extend outwardly from the lip 62 at both sides of the primary support section 16 for engaging corresponding pockets 70 on the exhaust filter door 24. An exhaust filter door mounting recess 72 is formed in the lower portion of the primary support section 16. The mounting recess 72 further comprises bearing holes 74 for receiving horizontal mounting pins 76 that protrude from the filter door 24.

The exhaust filter door 24 comprises an arcuate front vertical wall 78 that extends around the front half of the exhaust filter door 24. The bottom 80 of the front wall mates with the lip 62 on the primary support section 16. The front wall 78 further comprises a plurality of exhaust apertures 82 formed therein. Slots or other aperture shapes are also suitable. The engagement tab 66 extends downwardly from the front wall 78 for selectively engaging mating slot 64 on the primary support section 16. In addition to the integrally molded engagement tab 66, alternative door locking means such as independent latch components or the like may also be used. A protrusion 84 projects upwardly from the top surface of the filter door 24 and provides a location feature for the dirty air separator or cyclone module 86 (FIG. 2). The protrusion 84 mates to a corresponding recess 88 (not shown) in the dirt release door 89 of the cyclone module 86 (FIG. 2). The side walls 90 of the protrusion 84 and corresponding recess 88 (not shown) are preferably angled at 120 degrees with respect to horizontal to provide a sufficient lead-in for improving the ease of cyclone module installation and orientation. A lead-in angle range of 110-145 degrees with respect to horizontal is also suitable. The top portion 92 of the arcuate front wall 78 overlaps and retains the leading lower face of the cyclone module 86 (FIG. 2). A second raised protrusion 94 connects the large protrusion 84 to the inner surface of the arcuate front wall 78. The second protrusion 94 has angled sidewalls 96 and is received within a second corresponding recess 97 (FIG. 2) formed in the dirt release door 89 to insure proper rotational orientation of the cyclone module 86 during installation. A mounting hinge 98 extends from the back of the exhaust filter door 24 for engagement with mounting recess 72 formed in the primary support section 16. Two flexible vertical fingers 100 protrude upwardly from the back of the exhaust filter door 24. Mounting pins 76 extend outwardly along a horizontal axis from the top of each flexible vertical finger 100. The leading face 102 of each mounting pin 76 is chamfered to improve assembly with the mounting recess 72 and corresponding bearing holes 74.

Figure 4:
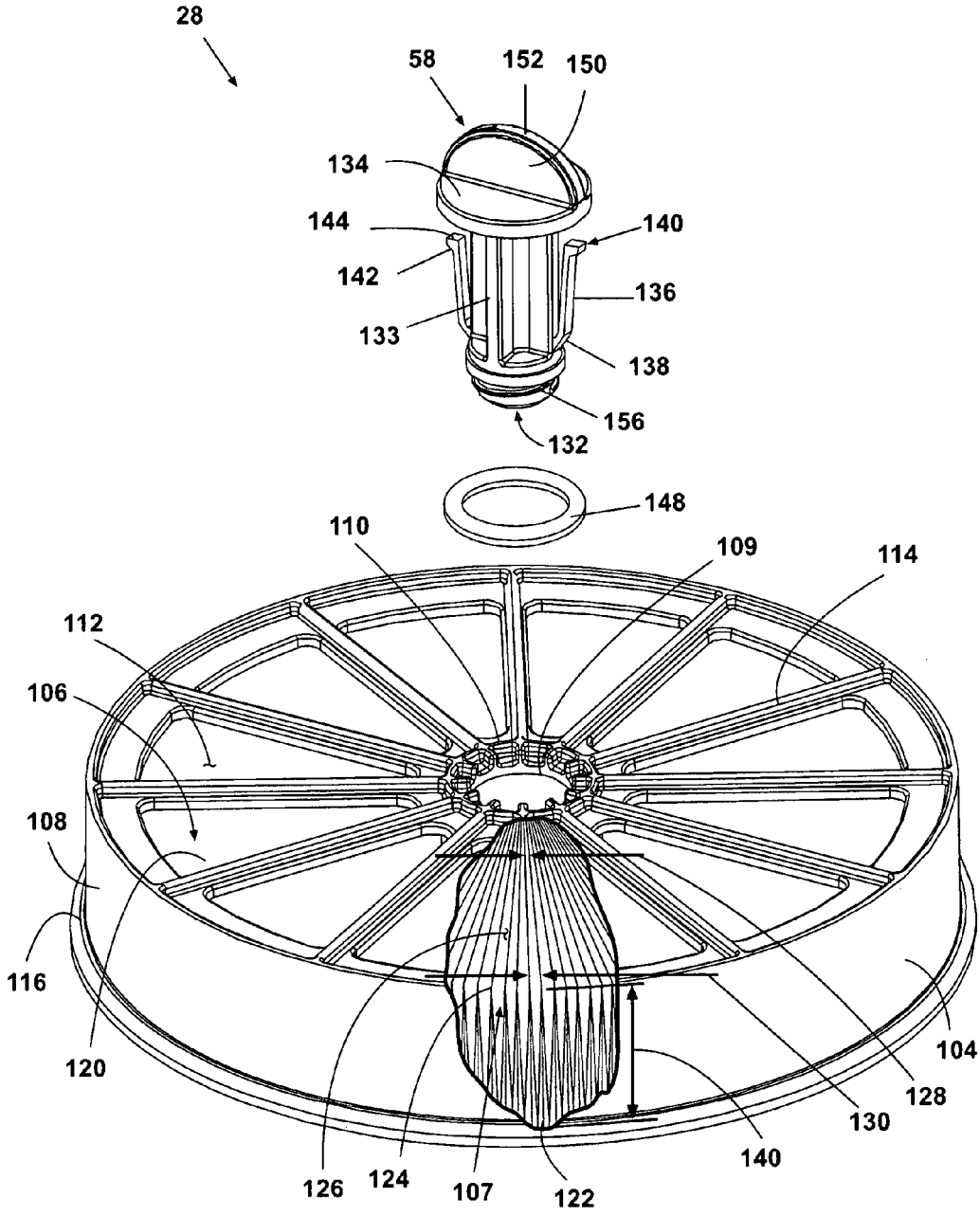
FIG. 4 is an exploded view of one embodiment of an exhaust filter according to the invention.
Figure 5:
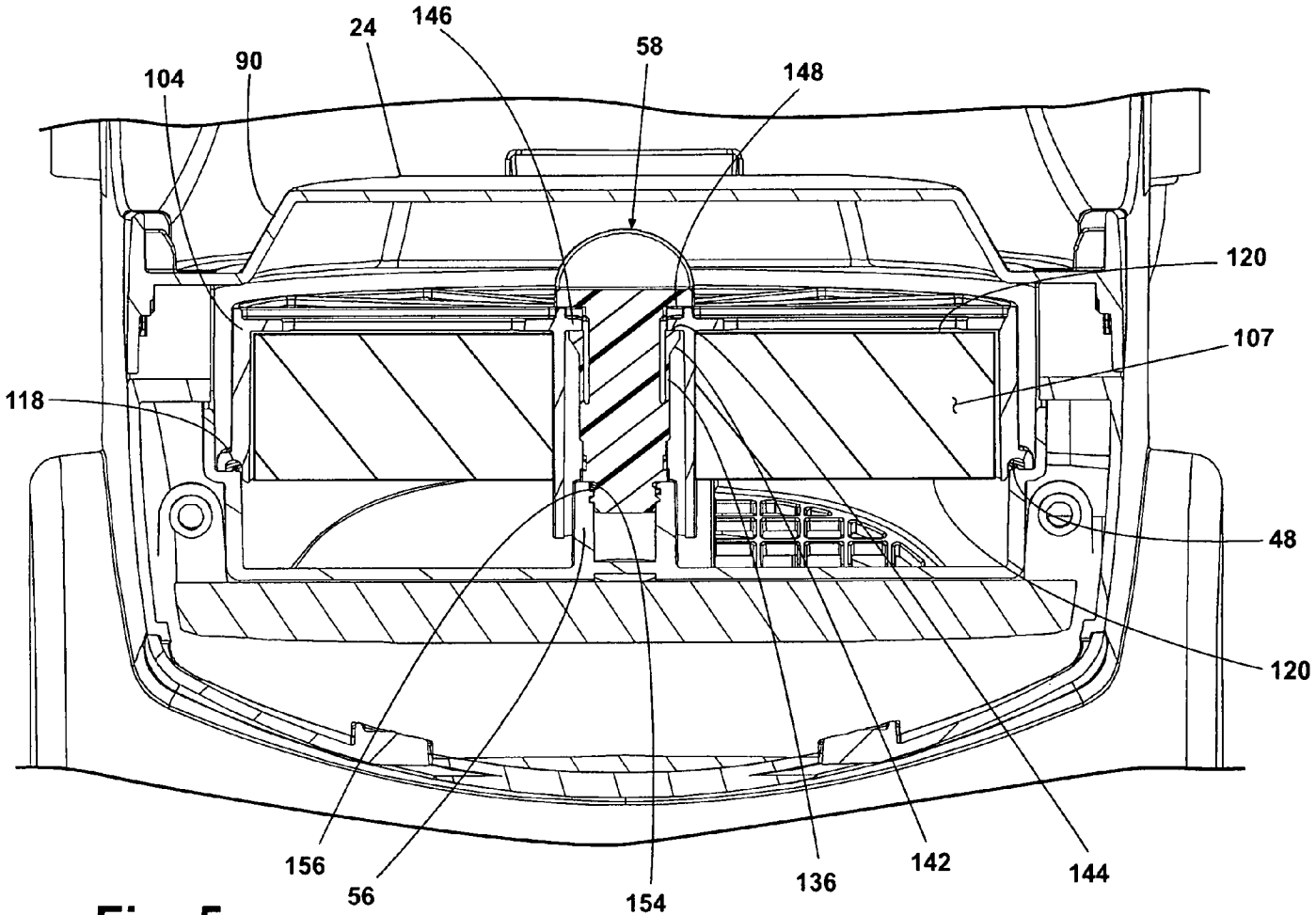
FIG. 5 is a partial cross-section view of the exhaust filter of FIG. 4.

Now referring to FIGS. 4-5, the exhaust filter assembly 28 comprises a filter frame 104, a filter element 106, a resilient gasket 48, and a locking lug 58. The filter frame 104 is preferably an injection molded component that can molded from an assortment of commonly known materials including, but not limited to, Acrylonitrile Butadiene Styrene (ABS), Polyethylene (PE), Polypropylene (PP), or the like. The filter frame 104 comprises a cylindrical outer wall 108 and a cylindrical inner wall 109 that forms a locking lug retainer or central hub 110 and a cavity formed between the outer wall 108 and inner wall 109. Radial cross members 114 extend outwardly from the top of the central hub 110 to the cylindrical outer wall 108, thereby forming "pie-shaped" openings 112. The radial cross members 114 provide structural rigidity to the filter frame 104 while also providing adequate open area to avoid excessive exhaust airflow restriction. A lip 116 extends around the bottom perimeter of the outer cylindrical wall 108 with a recessed channel 118 formed in the bottom side to receive a resilient gasket 48. The resilient gasket 48 provides an airtight seal between the filter assembly 28 and the filter chamber 26. While the resilient gasket 48 is preferably affixed to the filter frame 104 as previously described, the resilient gasket 48 can optionally be affixed to a portion of the filter chamber 26, including the seat 44. The resilient gasket 48 preferably comprises a resilient closed cell foam material, but additional resilient materials such as rubber, EPDM, silicone, or the like may also be used.

The filter element 106 is generally cylindrical and is configured to trap airborne particulates, such as dirt, dust, mold, bacteria, and pollen as air passes through. The filter element 106 preferably comprises pleated high efficiency particulate air (HEPA) media with two non-woven polyethylene sheets 120 adhered to the top and bottom surfaces thereof. Additional suitable filter media materials such as ultra-low particulate air (ULPA) media, commonly known non-woven materials, and open-cell foam may also be used. The filter assembly 28 is configured for easy replacement so that when the filter element 106 becomes clogged with particulates, the filter element 106 can be removed and disposed or recycled, and a new filter assembly 28 can be installed in its place. A sufficient area of exposed filter media surface area is critical to reduce clogging and provide a longer useful life of effective filtration performance between filter replacements, especially when HEPA or ULPA filter media is used. According to the present invention, the minimum exposed HEPA filter media surface area is preferably greater than or equal to 0.27 square meters [$m^2$]. It has been found that a filter media surface area of less than 0.27 square meters will result in premature filter clogging and reduce filtration capability and vacuum performance. The HEPA filter media 107 is preferably pleated to maximize the exposed surface area contained within the compact cylindrical filter frame 104. The pleats 122 extend radially outward from the central hub 110. The distance between the peaks 124 of adjacent pleats 122 is generally referred to as the pleat pitch 126. The pleat pitch 126 gradually increases as adjacent pleats extend outwardly from the central hub 110 to the outer wall 108. As shown in FIG. 4, this cylindrical filter design comprises a preferred inner pleat pitch 128 of 0.8 mm with an acceptable range of 0.4 mm to 2 mm and a preferred outer pleat pitch 130 of 3.6 mm with an acceptable range of 2-5 mm. The preferred pleat height 131 is 22 mm with an acceptable range of 15-50 mm.

Continuing to refer to FIGS. 4-5, the exhaust filter assembly 28 further comprises a locking lug 58 with a shaft 133 having a threaded leading end 132 to engage the retention hub 56 and a flange 134 on the opposing end to compress the exhaust filter assembly 28 onto the filter chamber seat 44. Resilient arms 136 on opposing sides of the shaft 133 are configured to axially retain the lug 58 to the filter assembly 28 while permitting it to rotate freely within the central hub 110. Each resilient arm 136 is preferably integral to the locking lug 58 and further comprises a first end 138 that is flexibly connected to the shaft 133 and a cantilever end 140 that is spaced apart from the shaft 133. The cantilever end 140 comprises an outwardly ramped face 142 and a retention stop 144 for axially retaining the locking lug 58 to the filter assembly 28. In this configuration, the locking lug 58 can be subjected to a one-time installation whereby the resilient arms 136 of the locking lug 58 flex inwardly towards the shaft 133 as the outwardly ramped faces 142 of the cantilever ends 140 contact the top of the central hub 110 and are forced inward by a central hub flange 146. When the locking lug 58 reaches its seated position, it forms an interlocking connection that is adapted to rotatably mount the locking lug 58 in the filter frame 104. The interlocking connection precludes removal of the filter locking lug 58 from the filter frame 104 without the use of tools.

The interlocking connection is formed by the resilient arms 136 as they spring back to their original position, thus moving the cantilever end 140 away from the shaft 133, such that the retention stops 144 are positioned beneath the central hub flange 146 to axially retain the locking lug 58 therein. A sealing washer 148 is positioned between the bottom of the locking lug flange 134 and the top of the central hub 110 to prevent undesirable leakage of air or dust from the central hub opening. The lug 58 further comprises a finger grip 150 that protrudes upwardly from the flange 134 for user manipulation. The finger grip 150 comprises a semicircular raised rib 152, which can be grasped by a user for easy rotation of the locking lug 58. In an alternate configuration, the resilient arms for retaining the locking lug can be formed by separate components affixed to the locking lug 58, such as leaf springs or the like. Additional non-limiting examples of alternative means to retain the locking lug 58 include a c-ring, cotter pin, or any other suitable shaft retainer. While it has been illustrated that the resilient arms are integral to the locking lug 58 and the flange is integral to the filter assembly 28, it is within the scope of the invention to reverse these elements so that the resilient arms are integral to the filter assembly and the flange is integral to the locking lug.

The locking lug 58 is received within the central hub 110 of the exhaust filter assembly 28 and can rotate freely therein. The threaded leading end 132 is configured to engage receiving threads 154 formed on the inner surface of the retention hub 56 such that when the locking lug 58 is rotated clockwise, the locking lug 58 is drawn into the retention hub 56 and when the locking lug 58 is rotated counter-clockwise, the locking lug 58 is released from the retention hub 56 and the locking lug 58 together with the filter assembly 28 can be removed. The threads 156 on the locking lug 58 are preferably configured to draw the lug 58 into the seated position when the lug 58 is rotated through a single revolution, although an angular rotation greater than or less than 360 degrees is also suitable. Furthermore, it is also contemplated that the threads 154, 156 on the retention hub 56 and the locking lug 58 can be replaced by commonly known bayonet style retention features, snap features, or the like.

Referring to FIG. 5, the filter assembly 28 is typically mounted in the filter chamber 26 of the vacuum cleaner 10 at the point of manufacture. To remove the exhaust filter assembly 28 from the filter chamber 26, a user must first release the filter door 24 by applying a lateral force perpendicular to the arcuate front wall 78 of the filter door 24. The force applied by a user deflects the arcuate front wall 78 and thereby releases the tab 66 from the receiving slot 64. The user can then pivot the filter door 24 upward to gain access to the filter chamber 26. The user then grasps the finger grip 150 and rotates the locking lug 58 counterclockwise to release the threaded leading end 132 from the retention hub 56. Upon releasing the locking lug 58, the user can remove the exhaust filter assembly 28 from the filter chamber 26. A user can then replace the spent filter assembly 28 with a new one and follow the same process in reverse order to sealingly secure the new filter assembly 28 to the filter chamber 26 and to lock the filter door 24 in place.

Figure 6:
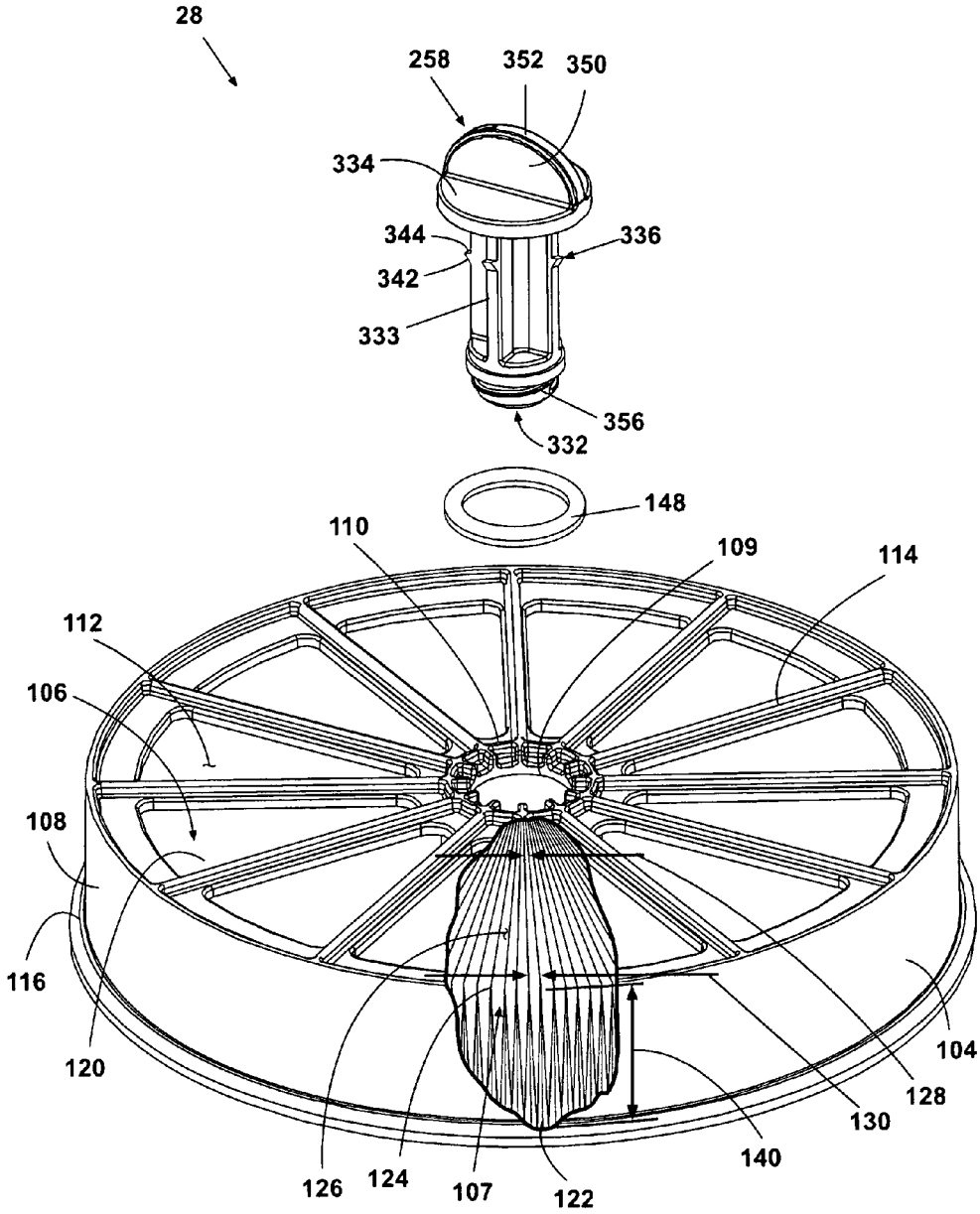
FIG. 6 is an exploded view of another embodiment of an exhaust filter according to the invention.
Figure 7:
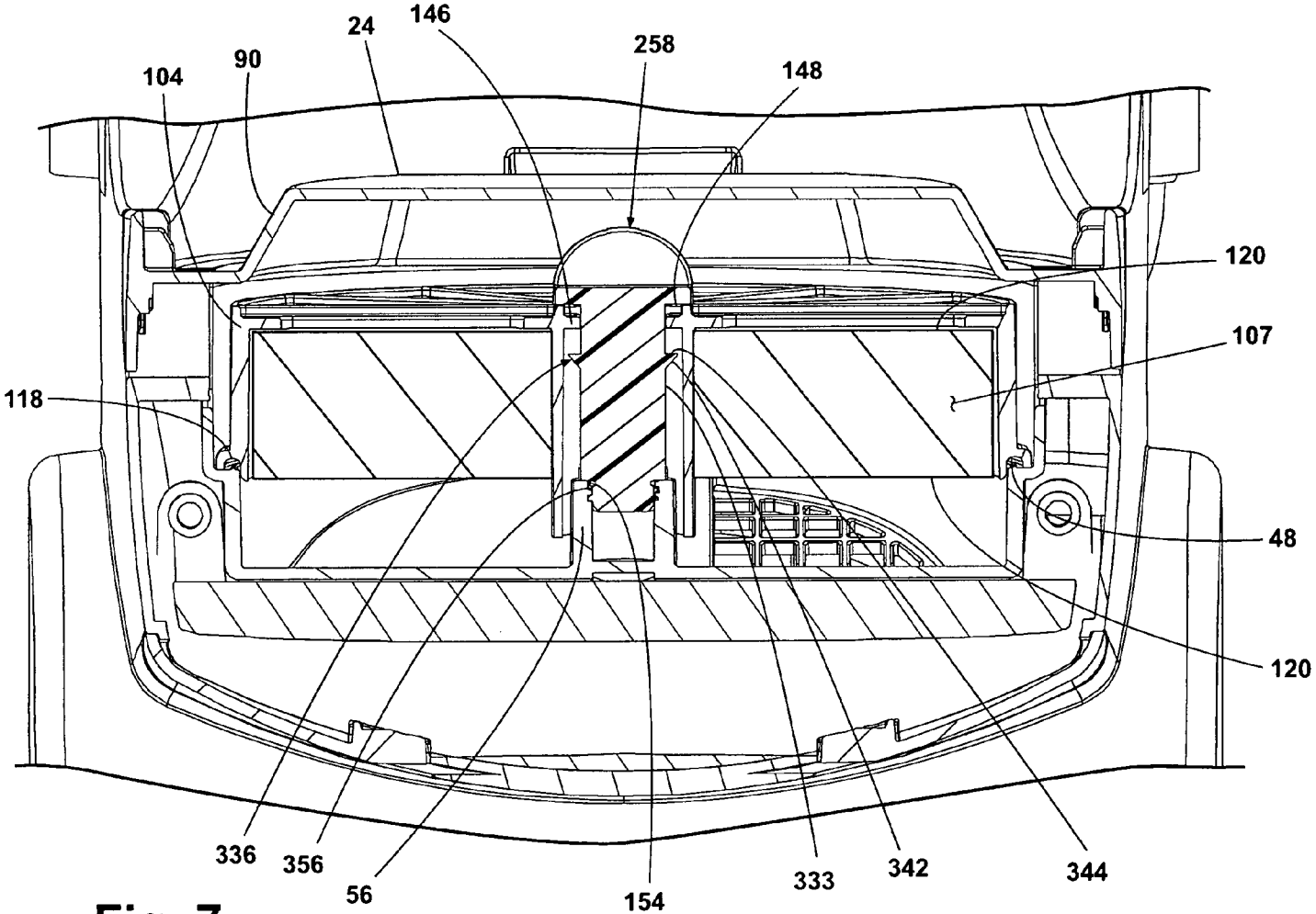
FIG. 7 is a partial cross-section view of the exhaust filter of FIG. 6.

Now referring to FIGS. 6-7, the exhaust filter assembly 28 may alternatively comprise a filter frame 104, a filter element 106, a resilient gasket 48, and a locking lug 258 according to a second embodiment of the invention. The second embodiment of the locking lug 258 is similar to the first embodiment 58. Therefore, like parts will be identified with like numerals increased by 200, with it being understood that the description of the like parts of the first embodiment applies to the second embodiment, unless otherwise noted.

One difference between the first embodiment 58 and the second embodiment 258 is that the locking lug 258 has integral ramps 336 on each side of the shaft 333. The ramps 336 are configured to retain the locking lug 258 to the filter assembly 28 while permitting it to rotate freely within the central hub 110. Each ramp 336 is preferably integral to the locking lug 258 and further comprises an outwardly ramped face 342 and a retention stop 344 for axially retaining the locking lug 258 to the filter assembly 28.

In this configuration, the locking lug 258 can be subjected to a one-time installation whereby the ramps 336 of the locking lug 258 may be forced below the central hub flange 146. When the locking lug 258 reaches its seated position, it forms an interlocking connection that is adapted to rotatably mount the locking lug 258 in the filter frame 104. The interlocking connection is formed by the ramps 336 as the outwardly ramped face 342 is forced below the central hub flange 146 such that the retention stops 344 are positioned beneath the central hub flange 146 to axially retain the locking lug 258 therein. The interlocking connection precludes removal of the filter locking lug 258 from the filter frame 104 without the use of tools.

Figure 8:
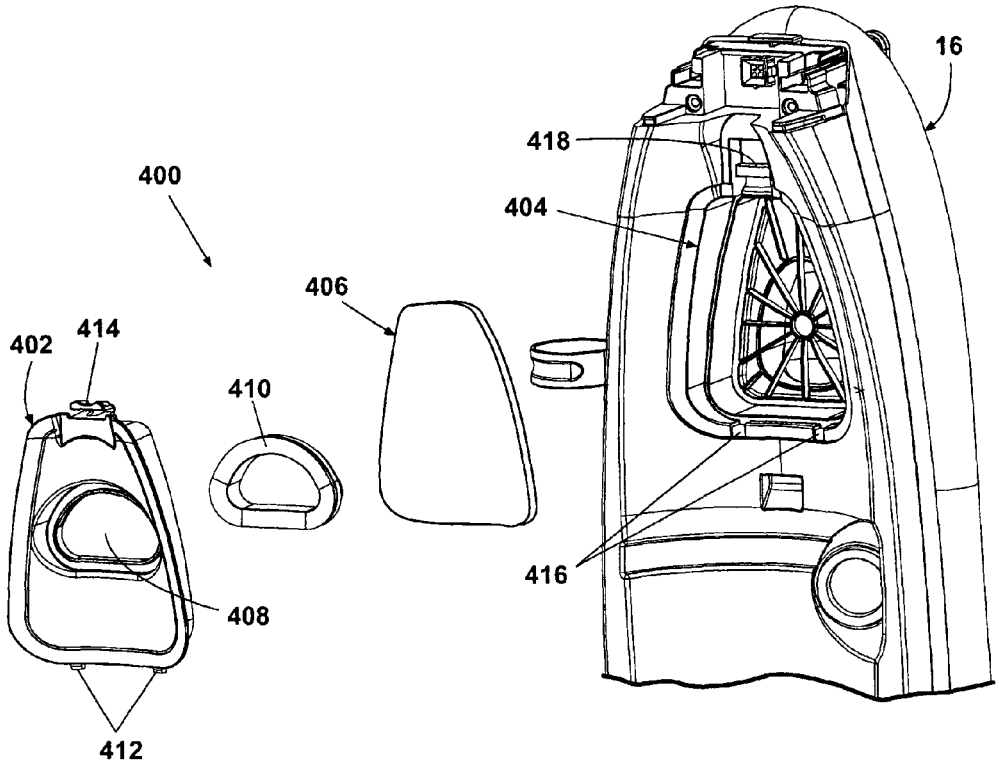
FIG. 8 is an exploded view of a pre-motor filter assembly according to the invention.

Referring to FIGS. 2 and 8, a pre-motor filter assembly 400 is located in an upper portion of the primary support section 16 and fluidly communicates with an outlet portion of the cyclone module 86. The upper location in the primary support section provides a pre-motor filter assembly 400 that is easily viewable by the user when the cyclone module 86 is removed from the primary support section 16. The pre-motor filter assembly 400 comprises a filter cover 402 removably engaged with an inlet plenum 404 formed in the primary support section 16 and captures a commonly known removable foam filter 406. The filter cover 402 further comprises an aperture 408 formed therethrough to which a commonly known gasket or seal 410 is affixed in a conventional manner to mate and seal the aperture 408 with a corresponding surface in the inlet plenum 404. The filter cover 402 further comprises at least one engagement rib 412 extending from a lower surface. A commonly known U-shaped latch tab 414 is located on an upper surface. Preferably, the filter cover 402 is made from a transparent material to provide the user an unimpeded view of the foam filter 406; however, translucent or opaque materials are also contemplated. The inlet plenum 404 is integrally molded in the primary support section 16 and provides a housing for the foam filter 406. The inlet plenum 404 further comprises at least one engagement rib recess 416 formed at a lower surface and a latch tab receiver 418 formed at an upper surface that correspond with the filter cover 402 engagement rib 412 and latch tab 414 respectively.

In operation, the user removes the cyclone module 86 and the pre-motor filter assembly 400 is easily visible. If the foam filter 406 is loaded with fine debris, the user pushes down the latch tab 414 to disengage the latch tab 414 from the latch tab receiver 418 and pivots the filter cover 402 down and forward at the engagement rib 412. When the back of the filter cover 402 clears the inlet plenum 404, the filter cover 402 can be lifted up and removed from the inlet plenum 404. The foam filter 406 can be removed from the inlet plenum 404 and cleaned or replaced as necessary. The filter cover 402 can then be replaced.

While the invention has been specifically described in connection with certain specific embodiments thereof, it is to be understood that this is by way of illustration and not of limitation. It is anticipated that the features described can be applied to any cyclone separation device utilizing a single cyclone, or two or more cyclones arranged in any combination of series or parallel airflows. In addition, it is understood that a vacuum cleaner employing a bag filter or another bagless—type of separation assembly can employ the filter assembly described herein. Moreover, the filter assembly can also be used in conjunction with a vacuum cleaner employing a separate pre-motor filter assembly. Conversely, the filter assembly can, with minimal modifications, function as a pre-motor filter assembly itself. Whereas the invention has been described with respect to an upright vacuum cleaner, the invention can also be used with other forms of vacuum cleaners, such as canister or central vacuum cleaners. Reasonable variation and modification are possible within the scope of the forgoing disclosure and drawings without departing from the spirit of the invention which is defined in the appended claims.

What is claimed is:

1. A filter assembly for a vacuum cleaner comprising:

a filter element comprising a filter frame that includes a cavity that receives a filter; and a filter locking lug wherein the filter locking lug, the filter element, and the filter frame include an interlocking connection that is adapted to rotatably mount the locking lug in the filter element and the filter frame.

2. The vacuum cleaner of claim 1, wherein the filter frame and locking lug comprise an interlocking connection that is adapted to rotatably mount the locking lug in the filter frame.

3. The vacuum cleaner of claim 2, wherein the interlocking connection comprises integral resilient arms and a flange.

4. The vacuum cleaner of claim 3, wherein the integral resilient arms are formed on the locking lug and wherein the flange is formed on the filter frame.

5. The vacuum cleaner of claim 2, wherein the interlocking connection comprises integral ramps and a flange.

6. The vacuum cleaner of claim 5, wherein the integral ramps are formed on the locking lug and wherein the flange is formed on the filter frame.

7. The vacuum cleaner of claim 2, wherein the interlocking connection precludes removal of the filter locking lug from the filter frame without the use of tools.

8. A vacuum cleaner comprising:

a housing including a suction nozzle and a dirty air separator for removing dirt and debris from a dirt laden air stream;

at least one suction source mounted in the housing having a suction inlet connected to the dirty air separator and the suction nozzle to draw air into the suction nozzle and through the dirty air separator, and having a suction source outlet;

an exhaust outlet aperture in the housing connected to the suction source outlet;

a filter element removably mounted in the housing between the exhaust outlet aperture and the suction source outlet, wherein the filter element comprises a filter frame that includes a cavity that receives a filter; and a filter locking lug that is rotatably mounted to the filter frame through an interlocking connection and that is configured to be removably retained in a locking lug retainer in the housing for removably securing the filter element to the housing.

9. The vacuum cleaner of claim 8, wherein the interlocking connection comprises integral resilient arms and a flange.

10. The vacuum cleaner of claim 9, wherein the integral resilient arms are formed on the locking lug and wherein the flange is formed on the filter frame.

11. The vacuum cleaner of claim 8, wherein the interlocking connection comprises integral ramps and a flange.

12. The vacuum cleaner of claim 11, wherein the integral ramps are formed on the locking lug and wherein the flange is formed on the filter frame.

13. The vacuum cleaner of claim 8, wherein the interlocking connection precludes removal of the filter locking lug from the filter frame without the use of tools.

14. A vacuum cleaner comprising:

a housing including a suction nozzle, a dirty air separator for removing dirt and debris from a dirt laden air stream, and an exhaust filter chamber;

at least one suction source mounted in the housing having a suction inlet connected to the dirty air separator and the suction nozzle to draw air into the suction nozzle and through the dirty air separator, and having a suction source outlet connected to the exhaust filter chamber through an exhaust outlet aperture;

an exhaust filter door mounted to the housing for movement between an enclosed position covering the exhaust filter chamber and an access position to provide selective access to the exhaust filter chamber;

an exhaust aperture in the exhaust filter door;

a filter element removably mounted in the exhaust filter chamber between the exhaust aperture in the exhaust filter door and the exhaust outlet aperture; and a filter locking lug mounted to the filter element and removably mounted to the housing for removably securing the filter element to the housing.

15. The vacuum cleaner of claim 14, wherein the filter element comprises a filter frame that includes a cavity that receives a filter, and wherein the housing comprises a locking lug retainer that is adapted to removably retain the locking lug.

16. The vacuum cleaner of claim 15, wherein the locking lug is rotatably receivable within the locking lug retainer.

17. The vacuum cleaner of claim 16, further comprising a threaded connection between the locking lug and the locking lug retainer.

18. The vacuum cleaner of claim 15, wherein the filter element is cylindrical and includes a central hub wherein the locking lug is retained.

19. The vacuum cleaner of claim 14, further comprising a seal located between the housing and the filter element to prevent dust from escaping the housing.

* * * * *